US006434790B1

(12) United States Patent
Chen

(10) Patent No.: US 6,434,790 B1
(45) Date of Patent: Aug. 20, 2002

(54) PULL ROD OF LUGGAGE

(76) Inventor: Shou-Mao Chen, 344, Sec. 1, Chung Shan Rd., Ta Cha Township, Taichung Hsien (TW)

( * ) Notice: Subject to any disclaimer, the term of this patent is extended or adjusted under 35 U.S.C. 154(b) by 31 days.

(21) Appl. No.: 09/633,646

(22) Filed: Aug. 7, 2000

(51) Int. Cl.[7] ..... A45C 13/26
(52) U.S. Cl. ..... 16/113.1; 16/430; 16/411
(58) Field of Search ..... 16/113.1, 429, 16/405, 430, 410, 411; 190/39, 115, 18 A, 18 R, 117; 280/655.1, 655, 47.371, 47.17; 403/164, 165, 258, 260

(56) References Cited

U.S. PATENT DOCUMENTS

| | | | | |
|---|---|---|---|---|
| 737,667 A | | 9/1903 | Schunck | |
| 3,136,148 A | | 6/1964 | Nehls | |
| 3,914,966 A | | 10/1975 | Bello | |
| 4,268,055 A | * | 5/1981 | Bell | 280/278 |
| 4,527,407 A | | 7/1985 | Shanklin | |
| 5,197,579 A | * | 3/1993 | Bieber et al. | 190/18 A |
| 5,402,587 A | | 4/1995 | Buschbacher | 135/67 |
| 5,464,080 A | * | 11/1995 | Liang | 190/18 A |
| 5,890,570 A | * | 4/1999 | Sadow | 190/18 A |
| 6,081,964 A | * | 7/2000 | Mori | 174/65 G |
| 6,122,800 A | * | 9/2000 | Cheng | 16/113.1 |
| 6,134,743 A | * | 10/2000 | Schmidt | 15/145 |
| 6,292,979 B1 | * | 9/2001 | Kuo | 16/113.1 |
| 6,297,449 B1 | * | 10/2001 | Dagtekin | 174/65 G |

* cited by examiner

*Primary Examiner*—Anthony Knight
*Assistant Examiner*—Doug Hutton
(74) *Attorney, Agent, or Firm*—Harrison & Egbert

(57) ABSTRACT

A luggage pull rod is formed of an outer tube and an inner tube slidably fitted into the outer tube such that the top end of the outer tube and the bottom end of the inner tube are connected by a buffer member capable of absorbing shock. The pull rod is provided with a hand grip which is pivotally fastened to the top end of the inner tube.

1 Claim, 7 Drawing Sheets

PULL ROD OF LUGGAGE

BACKGROUND OF THE INVENTION

1. Field of the Invention

The present invention relates generally to a luggage, and more particularly to a pull rod for the luggage.

2. Description of Related Art

The conventional luggage pull rod is generally expandable and is formed of an outer tube and an inner tube which is telescopically fastened to the outer tube such that the inner tube can be adjustably pulled out of the outer tube as desired. The conventional luggage pull rod is defective in design because it is not provided with an adequate rigidity to protect the pull rod against the deformity caused by the weight of the articles contained in the luggage at the time when the luggage is moved on the surface by the user's had supporting pull rod of the luggage. In addition, the conventional luggage pull rod has a grip which is fixed and cannot be adjusted to allow the hand to hold it with ease and comfort.

BRIEF SUMMARY OF THE INVENTION

The primary objective of the present invention is to provide a luggage pull rod which is free from the drawbacks of the conventional luggage pull rod described above.

In keeping with the principle of the present invention, the foregoing objective of the present invention is attained by a luggage pull rod comprising an outer tube, an inner tube, a buffer member, a grip, and a pivoting member. The inner tube is fastened telescopically to the outer tube such that the top end of the outer tube and the bottom end of the inner tube are provided with the buffer member. The grip is adjustably fastened to the top end of the inner tube by the pivoting member.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
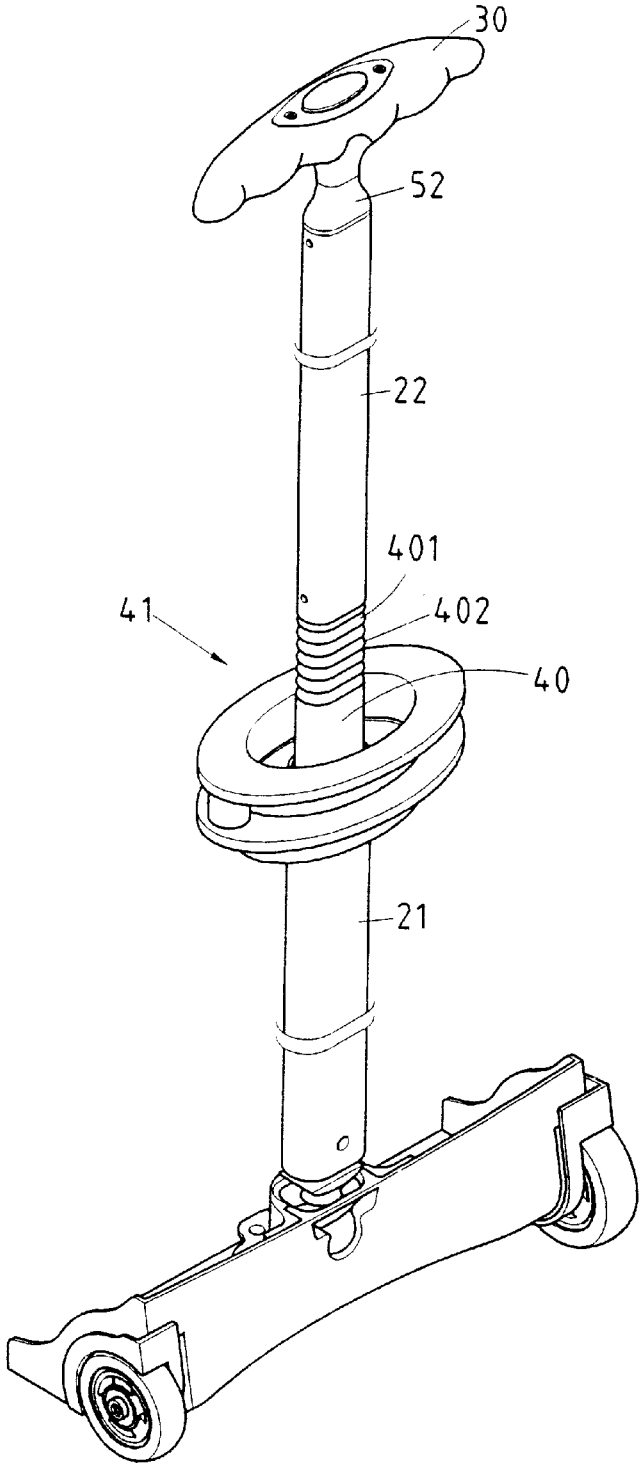
FIG. 1 shows a perspective view of the preferred embodiment of the rent invention.
Figure 2:
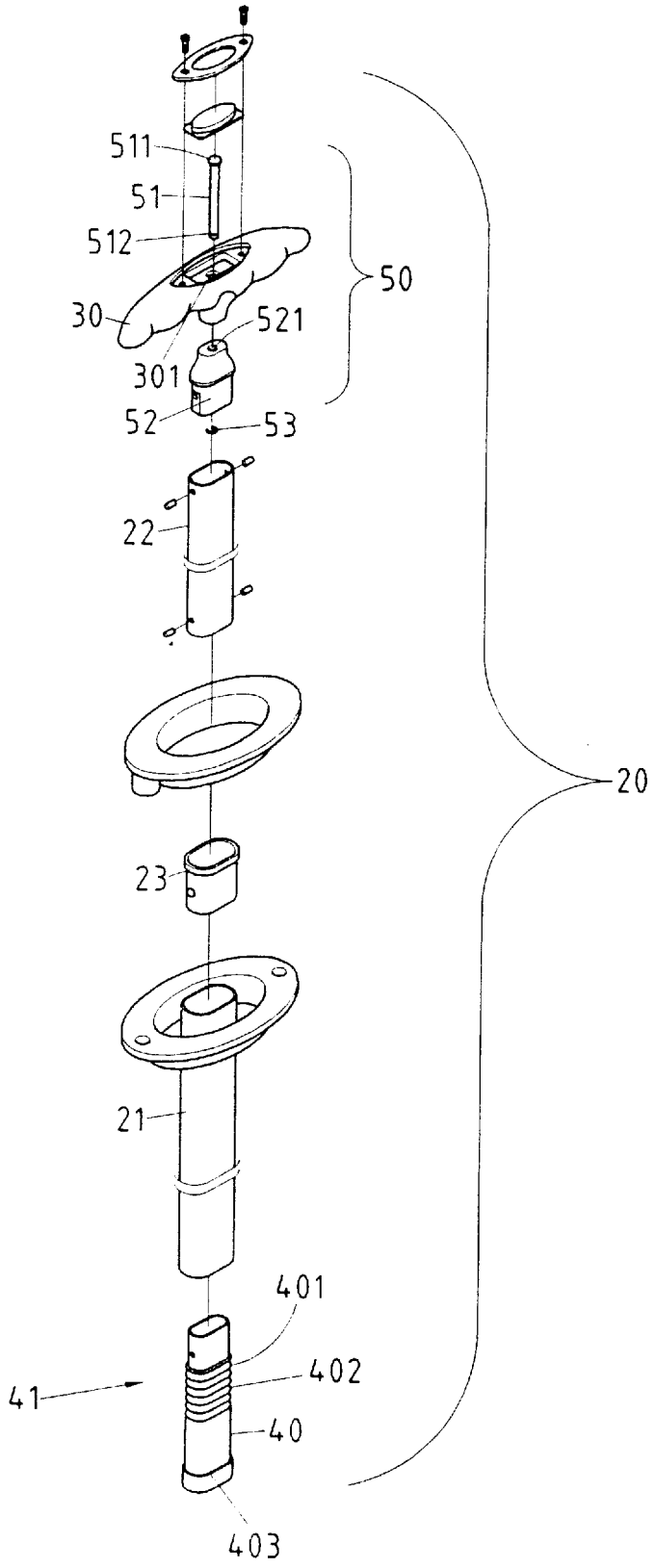
FIG. 2 shows an exploded view of the preferred embodiment of the present invention.
Figure 3:
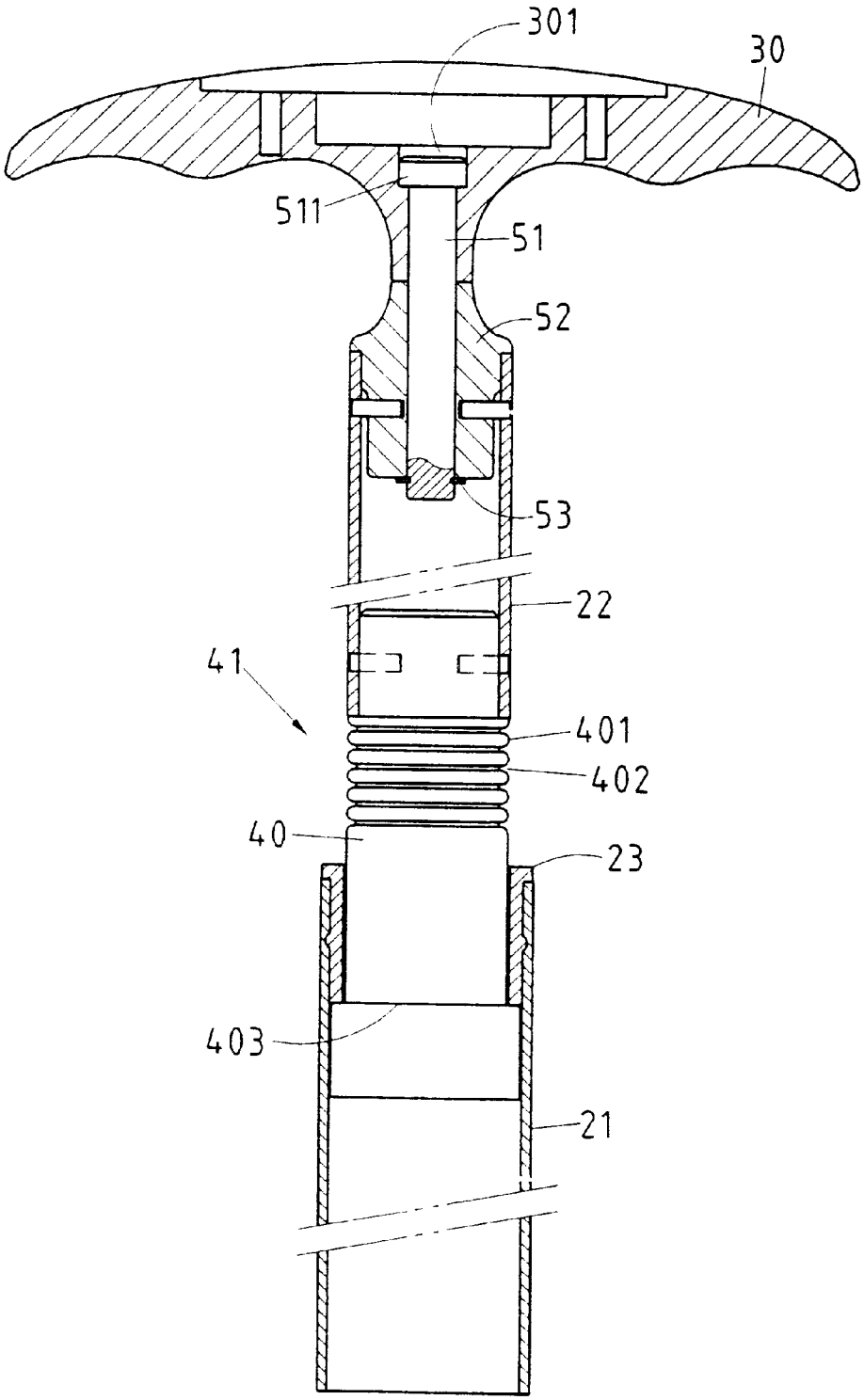
FIG. 3 shows a longitudinal sectional view of the preferred embodiment of the present invention in combination.
Figure 4:
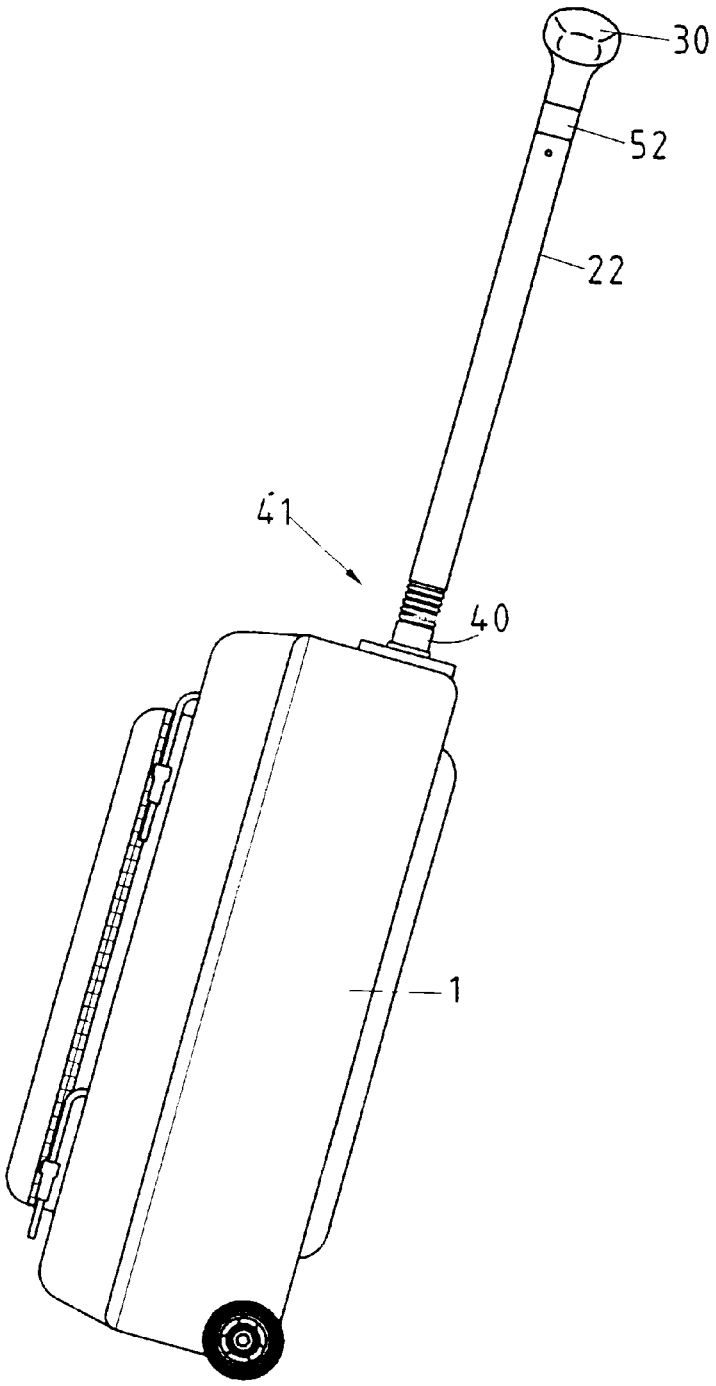
FIG. 4 shows a schematic view of the preferred embodiment of the present invention at work.

As shown in FIGS. 1–4, an expandable pull rod 20 of the preferred embodiment of the present invention is fastened internally or externally to a piece of luggage 1 and is formed of an outer tube 21 and an inner tube 22 which is slidably received in the outer tube 21. The top end of the outer tube 21 and the bottom end of the inner tube 22 are jointly provided with a buffer member 40.

The buffer member 40 has a predetermined length and is made of an elastic material. The buffer member 40 has a lower segment which is fitted into the outer tube 21, and an upper segment which is fitted into the inner tube 22. The buffer member 40 further has a midsegment which is provided in the outer wall thereof with a buffer area 41. The buffer area 41 is formed of a plurality of parallel ridges 401 and grooves 402. The upper segment of the buffer member 40 juts out of the top end of the outer tube 21 to fasten to the bottom end of the inner tube 22. As the inner tube 22 is pulled out of the outer tube 21, a stop edge 403 of the lower end of the buffer member 40 is retained in a retaining portion 23 located in the interior of the top end of the outer tube 21. In the meantime, the buffer area 41 of the buffer member 40 is visibly located between the top end of the outer tube 21 and the bottom end of the inner tube 22.

The inner tube 22 is provided at the top end with a hand grip 30 fastened pivotally thereto by a pivoting member 50, which is formed of a shaft rod 51 and a connection sleeve 52.

The shaft rod 51 has an enlarged top end 511, which is securely received in a T-shaped hole 301 of the hand grip 30. The shaft rod 51 is provided in the outer wall in the proximity of the bottom end thereof with a retaining groove 512.

The connection sleeve 52 is provided with a longitudinal through hole 521 dimensioned to receive the shaft rod 51 such that the bottom end of the shaft rod 51 juts out of the connection sleeve 52. A C-shaped retainer 53 is securely disposed in the retaining groove 512 of the shaft rod 51. The bottom end of the connection sleeve 52 is inserted into the top end of the outer tube 22.

Figure 5:
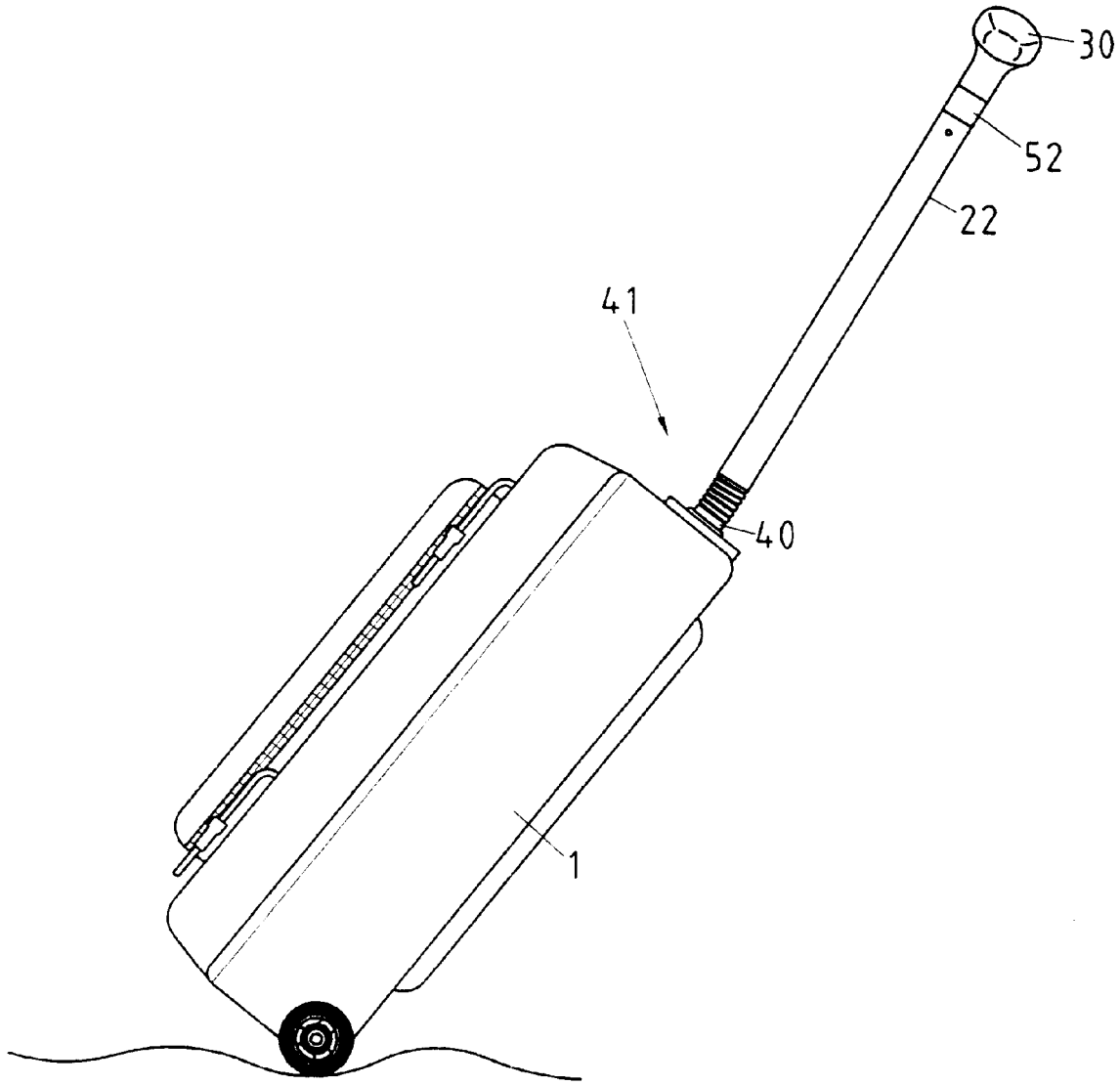
FIG. 5 shows a side schematic view of the preferred embodiment of the present invention at work.
Figure 6:
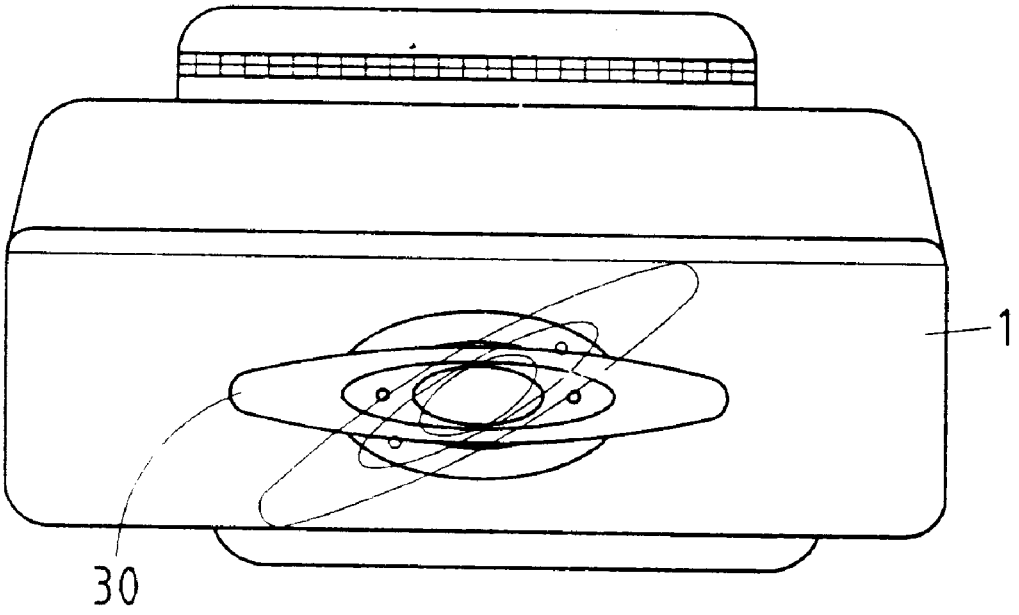
FIG. 6 shows a top schematic view of the grip of the present invention at work.
Figure 7:
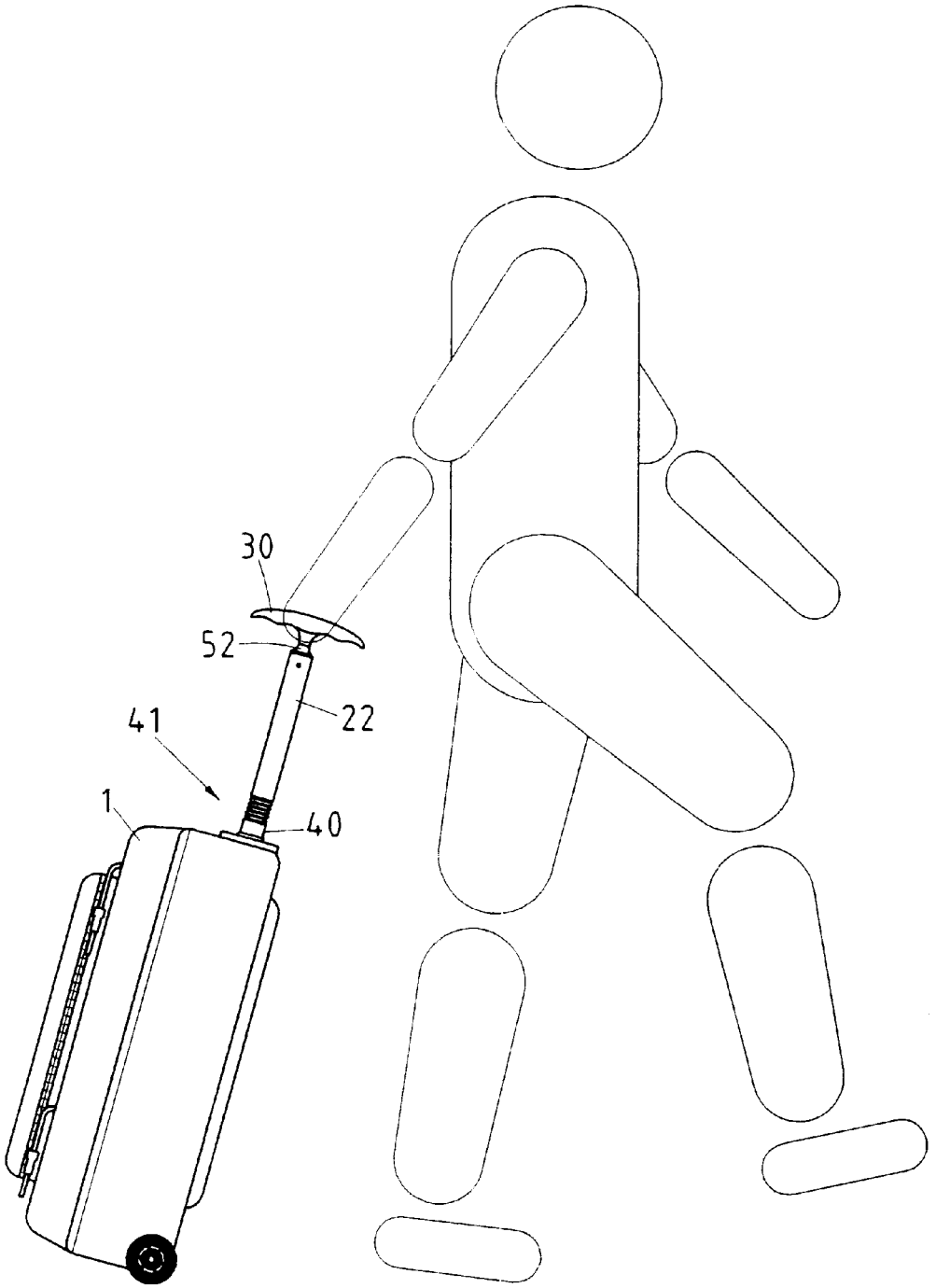
FIG. 7 shows a side schematic view of the grip of the preferred embodiment of the present invention at work.

As illustrated in FIGS. 4–7, when the inner tube 22 is fully pulled out of the outer tube 21 to facilitate the moving of the luggage 1 on the surface, the pull rod 20 of the present invention is not susceptible to damage or deformation caused by the weight of the articles which are contained in the luggage, because of the buffer member 40. The buffer area 41 of the buffer member 40 is capable of absorbing shock to prolong the service longevity of the pull rod 20 of the present invention. In addition, the hand grip 30 of the present invention can be swiveled to allow a maximum maneuverability of the hand held grip 30.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. A luggage pull rod assembly comprising:

an outer tube;

an inner tube slidably fitted into said outer tube;

a buffer member connecting a top end of said outer tube and a bottom end of said inner tube, said buffer member being of an elastic material, said buffer member having a lower segment and an upper segment and a midsegment located between said lower segment and said upper segment, said midsegment having a buffer area formed of a plurality of parallel ridges and a plurality of grooves respectively interposed between adjacent ridges of said plurality of parallel ridges, said lower segment fitted within said outer tube, said upper segment fitted into said inner tube, said buffer area being visibly positionable between said top end of said outer lube and said bottom end of said inner tube, said lower segment having a stop edge abutting a retaining portion in an interior of said top end of said outer tube when said inner tube is pulled fully outwardly of said outer tube; and a hand grip pivotally fastened with a pivoting member to a top end of said inner tube, said pivoting member comprising:

a shaft rod having an enlarged top end, said enlarged top end retained in a T-shaped hole in said hand grip, said shaft rod having a retaining groove formed at a bottom end thereof;

a connection sleeve having a longitudinal through hole dimensioned to receive said shaft rod therethrough, said bottom end of said shaft rod extending outwardly of said connection sleeve; and a C-shaped retainer disposed in said retaining groove of said shaft rod.

* * * * *